US011721350B2

(12) United States Patent
Xu

(10) Patent No.: US 11,721,350 B2
(45) Date of Patent: Aug. 8, 2023

(54) SOUND QUALITY DETECTION METHOD AND DEVICE FOR HOMOLOGOUS AUDIO AND STORAGE MEDIUM

(71) Applicant: TENCENT MUSIC ENTERTAINMENT TECHNOLOGY (SHENZHEN) CO., LTD., Shenzhen (CN)

(72) Inventor: Dong Xu, Shenzhen (CN)

(73) Assignee: TENCENT MUSIC ENTERTAINMENT TECHNOLOGY (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 17/615,444

(22) PCT Filed: Dec. 30, 2019

(86) PCT No.: PCT/CN2019/130094
§ 371 (c)(1),
(2) Date: Nov. 30, 2021

(87) PCT Pub. No.: WO2020/238205
PCT Pub. Date: Dec. 3, 2020

(65) Prior Publication Data

US 2022/0230645 A1 Jul. 21, 2022

(30) Foreign Application Priority Data

May 31, 2019 (CN) ..... 201910468263.8

(51) Int. Cl.
*G10L 19/16* (2013.01)
*G10L 25/60* (2013.01)
(Continued)

(52) U.S. Cl.
CPC ..... *G10L 19/173* (2013.01); *G10L 19/18* (2013.01); *G10L 19/24* (2013.01); *G10L 25/48* (2013.01); *G10L 25/51* (2013.01); *G10L 25/60* (2013.01)

(58) Field of Classification Search
CPC ..... G10L 19/24; G10L 25/60; G10L 25/51; G10L 25/48; G10L 19/18
See application file for complete search history.

(56) References Cited

U.S. PATENT DOCUMENTS 6,609,092 B1 8/2003 Ghitza et al.
2017/0223453 A1* 8/2017 Kiyoshige ..... G10L 21/0232
(Continued)

FOREIGN PATENT DOCUMENTS

CN 104252480 A 12/2014
CN 104966518 A 10/2015
(Continued)

OTHER PUBLICATIONS

International Search Report of the International Searching Authority for State Intellectual Property Office of the People's Republic of China in PCT application No. PCT/CN2019/130094 dated Mar. 26, 2020, which is an international application corresponding to this U.S. application.

(Continued)

*Primary Examiner* — Samuel G Neway
(74) *Attorney, Agent, or Firm* — Kolitch Romano Dascenzo Gates LLC

(57) ABSTRACT

Provided is a sound quality detection method, including: acquiring a plurality of audio files to be detected, wherein the plurality of audio files are homologous audio files; acquiring at least one audio feature of each of the plurality of audio files by performing feature extraction on the audio file, and generating a correspondence list between the at (Continued)

least one audio feature of each of the plurality of audio files and an audio file identifier; and determining, using a sound quality detection model, a sound quality score of each of the plurality of audio files based on the correspondence list between the at least one audio feature of each of the plurality of audio files and the audio file identifier, wherein the sound quality detection model is configured to detect sound quality of homologous audio files.

16 Claims, 3 Drawing Sheets

(51) Int. Cl.

| | |
|---|---|
| ***G10L 25/48*** | (2013.01) |
| ***G10L 25/51*** | (2013.01) |
| ***G10L 19/24*** | (2013.01) |
| ***G10L 19/18*** | (2013.01) |

(56) References Cited

U.S. PATENT DOCUMENTS

| | | | | |
|---|---|---|---|---|
| 2020/0118578 | A1* | 4/2020 | Winarski | G10L 19/24 |
| 2022/0230645 | A1* | 7/2022 | Xu | G10L 25/60 |

FOREIGN PATENT DOCUMENTS

| | | | | | |
|---|---|---|---|---|---|
| CN | 105931634 | A | * | 9/2016 | G06F 17/3074 |
| CN | 105931634 | A | | 9/2016 | |
| CN | 106385622 | A | | 2/2017 | |
| CN | 106531190 | A | | 3/2017 | |
| CN | 107749300 | A | | 3/2018 | |
| CN | 107895571 | A | | 4/2018 | |
| CN | 108206027 | A | * | 6/2018 | G06N 3/08 |
| CN | 108766451 | A | | 11/2018 | |
| CN | 109176541 | A | | 1/2019 | |
| CN | 109308913 | A | | 2/2019 | |
| CN | 109785850 | A | | 5/2019 | |
| CN | 110189771 | A | | 8/2019 | |
| JP | 2001265324 | A | | 9/2001 | |

OTHER PUBLICATIONS

The State Intellectual Property Office of People's Republic of China, First Office Action in Patent Application No. CN201910468263.8 dated Jan. 6, 2021, which is a foreign counterpart application corresponding to this U.S. Patent Application, to which this application claims priority.

The State Intellectual Property Office of People's Republic of China, Second Office Action in Patent Application No. CN201910468263.8 dated Jun. 10, 2021, which is a foreign counterpart application corresponding to this U.S. Patent Application, to which this application claims priority.

Rejection Decision of Chinese Application No. 201910468263.8 dated Sep. 9, 2021.

* cited by examiner

SOUND QUALITY DETECTION METHOD AND DEVICE FOR HOMOLOGOUS AUDIO AND STORAGE MEDIUM

CROSS-REFERENCE TO RELATED APPLICATION

This application is a U.S. national stage of international application No. PCT/CN2019/130094, filed on Dec. 30, 2019, which claims priority to Chinese Patent Application No. 201910468263.8, filed on May 31, 2019 and entitled "METHOD FOR DETECTING TONE QUALITY OF HOMOLOGOUS AUDIO, DEVICE AND STORAGE MEDIUM," which is incorporated herein by reference in its entirety.

TECHNICAL FIELD

The present application relates to the field of audio technologies, and in particular, relates to a sound quality detection method and device for homologous audio and a storage medium.

BACKGROUND

At present, a music platform usually stores a large number of homologous audio files. Homologous audio files are audio files acquired by transcoding the same audio file one or more times, for example, audio files of the same song with different sound quality.

Due to the large number of homologous audio files stored in the music platform and uneven sound quality of the audio files, costs for storing, acquiring, and managing the homologous audio files are relatively high. Therefore, the sound quality of the homologous audio files needs to be detected to effectively manage the homologous audio files based on the sound quality, thereby reducing the costs of storing, acquiring, and managing the homologous audio files.

SUMMARY

Embodiments of the present application provide a sound quality detection method and device for homologous audio and a storage medium. The technical solutions are as follows:

According to one aspect, a sound quality detection method for homologous audio is provided. The method includes:

acquiring a plurality of audio files to be detected, wherein the plurality of audio files are homologous audio files;

acquiring at least one audio feature of each of the plurality of audio files by performing feature extraction on the audio file, and generating a correspondence list between the at least one audio feature of each of the plurality of audio files and an audio file identifier; and determining, using a sound quality detection model, a sound quality score of each of the plurality of audio files based on the correspondence list between the at least one audio feature of each of the plurality of audio files and the audio file identifier, wherein the sound quality detection model is configured to detect sound quality of homologous audio files.

Optionally, acquiring the at least one audio feature of each of the plurality of audio files by performing the feature extraction on the audio file includes:

by performing the feature extraction on a first audio file in the plurality of audio files, acquiring at least one of a sampling rate, a bit depth, a bitrate, a maximum value among energy roll-off differences of all frames, a spectral contrast, spectral flatness in time, a mean value of an energy shadow region upon audio energy normalization, a mean value and variance of normalized energy of all frames in time, a peak ratio of envelope amplitudes of all frames, spectral entropy, a spectral centroid, and a spectral height of the first audio file, wherein the first audio file is any one of the plurality of audio files.

Optionally, determining, using the sound quality detection model, the sound quality score of each of the plurality of audio files based on the correspondence list between the at least one audio feature of each of the plurality of audio files and the audio file identifier includes:

inputting the correspondence list between the at least one audio feature of each of the plurality of audio files and the audio file identifier to the sound quality detection model, and outputting the sound quality score of each of the plurality of audio files by the sound quality detection model.

Optionally, prior to determining, using the sound quality detection model, the sound quality score of each of the plurality of audio files based on the correspondence list between the at least one audio feature of each of the plurality of audio files and the audio file identifier, the method further includes:

acquiring a plurality of sets of sample data, wherein each of the plurality of sets of sample data includes a plurality of sample audio files that are homologous audio files, and sample sound quality scores of the plurality of sample audio files; and acquiring the sound quality detection model by training a to-be-trained sound quality detection model based on the plurality of sets of sample data.

Optionally, acquiring the plurality of sets of sample data may specifically include:

acquiring a source audio file for any set of sample data in the plurality of sets of sample data;

acquiring the plurality of sample audio files by continuously performing lossy transcoding on the source audio file M times, wherein M is a positive integer;

determining the sample sound quality score of each of the plurality of sample audio files; and determining the plurality of sample audio files and the sample sound quality scores of the plurality of sample audio files as the any set of sample data.

Optionally, acquiring the plurality of sample audio files by continuously performing the lossy transcoding on the source audio file M times includes:

acquiring a lossy audio file by performing the lossy transcoding on the source audio file;

determining the lossy audio file as an $r^{th}$ lossy audio file, and letting r=1;

acquiring an $(r+1)^{th}$ lossy audio file by performing the lossy transcoding on the $r^{th}$ lossy audio file;

in the case that r+1 is not equal to M, letting r=r+1, and returning to the step of acquiring the $(r+1)^{th}$ lossy audio file by performing the lossy transcoding on the $r^{th}$ lossy audio file; and in the case that r+1 is equal to M, determining the source audio file and the first lossy audio file to an $M^{th}$ lossy audio file as the plurality of sample audio files.

Optionally, prior to determining, using the sound quality detection model, the sound quality score of each of the plurality of audio files based on the correspondence list between the at least one audio feature of each of the plurality of audio files and the audio file identifier, the method further includes:

acquiring a plurality of sets of test data, wherein each set of test data includes a plurality of test audio files that are homologous audio files and sample sound quality scores of the plurality of test audio files;

determining, using the sound quality detection model, a test sound quality score of each of the plurality of test audio files in each of the plurality of sets of test data;

comparing the test sound quality score of each of the plurality of test audio files in each set of test data with the sample sound quality score; and performing the step of determining, using the sound quality detection model, the sound quality score of each of the plurality of audio files based on the correspondence list between the at least one audio feature of each of the plurality of audio files and the audio file identifier in response to determining, based on a comparison result, that the sound quality detection model meets a sound quality detection condition.

Optionally, upon comparing the test sound quality score of each of the plurality of test audio files in each set of test data with the sample sound quality score, the method further includes:

updating the sound quality detection model based on the plurality of sets of test data in response to determining, based on the comparison result, that the sound quality detection model does not meet the sound quality detection condition; and determining, using the sound quality detection model, the sound quality score of each of the plurality of audio files based on the correspondence list between the at least one audio feature of each of the plurality of audio files and the audio file identifier includes:

determining, using the sound quality detection model as updated, the sound quality score of each of the plurality of audio files based on the correspondence list between the at least one audio feature of each of the plurality of audio files and the audio file identifier.

Optionally, upon determining, using the sound quality detection model, the sound quality score of each of the plurality of audio files based on the correspondence list between the at least one audio feature of each of the plurality of audio files and the audio file identifier, the method further includes:

selecting first N audio files in the plurality of audio files ranked in descending order of their sound quality scores, wherein N is a positive integer; and determining the N audio files as first-type audio files and audio files other than the N audio files in the plurality of audio files as second-type audio files.

Optionally, upon determining the N audio files as the first-type audio files and the audio files other than the N audio files in the plurality of audio files as the second-type audio files, the method further includes:

deleting the second-type audio files.

According to one aspect, a sound quality detection device for homologous audio is provided. The device includes: a processor; and a memory configured to store at least one instruction executable by the processor; wherein the processor, when executing the at least one instruction, is caused to perform:

acquiring a plurality of audio files to be detected, wherein the plurality of audio files are homologous audio files;

acquiring at least one audio feature of each of the plurality of audio files by performing feature extraction on the audio file, and generating a correspondence list between the at least one audio feature of each of the plurality of audio files and an audio file identifier; and determining, using a sound quality detection model, a sound quality score of each of the plurality of audio files based on the correspondence list between the at least one audio feature of each of the plurality of audio files and the audio file identifier, wherein the sound quality detection model is configured to detect sound quality of homologous audio files.

Optionally, the processor, when executing the at least one instruction, is caused to perform:

by performing the feature extraction on a first audio file in the plurality of audio files, acquiring at least one of a sampling rate, a bit depth, a bitrate, a maximum value among energy roll-off differences of all frames, a spectral contrast, spectral flatness in time, a mean value of an energy shadow region upon audio energy normalization, a mean value and variance of normalized energy of all frames in time, a peak ratio of envelope amplitudes of all frames, spectral entropy, a spectral centroid, and a spectral height of the first audio file, wherein the first audio file is any one of the plurality of audio files.

Optionally, the processor, when executing the at least one instruction, is caused to perform:

inputting the correspondence list between the at least one audio feature of each of the plurality of audio files and the audio file identifier to the sound quality detection model, and outputting the sound quality score of each of the plurality of audio files by the sound quality detection model.

Optionally, the processor, when executing the at least one instruction, is further caused to perform:

acquiring a plurality of sets of sample data, wherein each of the plurality of sets of sample data includes a plurality of sample audio files that are homologous audio files and sample sound quality scores of the plurality of sample audio files; and acquiring the sound quality detection model by training a to-be-trained sound quality detection model based on the plurality of sets of sample data.

Optionally, the processor, when executing the at least one instruction, is caused to perform:

acquiring a source audio file for any set of sample data in the plurality of sets of sample data;

acquiring the plurality of sample audio files by continuously performing lossy transcoding on the source audio file M times, wherein M is a positive integer;

determining the sample sound quality score of each of the plurality of sample audio files; and determining the plurality of sample audio files and the sample sound quality scores of the plurality of sample audio files as the any set of sample data.

Optionally, the processor, when executing the at least one instruction, is caused to perform:

acquiring a lossy audio file by performing the lossy transcoding on the source audio file;

determining the lossy audio file as an $r^{th}$ lossy audio file, and letting r=1;

acquiring an $(r+1)^{th}$ lossy audio file by performing the lossy transcoding on the $r^{th}$ lossy audio file;

in the case that r+1 is not equal to M, letting r=r+1, and returning to the step of acquiring the $(r+1)^{th}$ lossy audio file by performing the lossy transcoding on the $r^{th}$ lossy audio file; and in the case that r+1 is equal to M, determining the source audio file and the first lossy audio file to an $M^{th}$ lossy audio file as the plurality of sample audio files.

Optionally, the processor, when executing the at least one instruction, is further caused to perform:

acquiring a plurality of sets of test data, wherein each set of test data includes a plurality of test audio files that are homologous audio files and sample sound quality scores of the plurality of test audio files;

determining, using the sound quality detection model, a test sound quality score of each of the plurality of test audio files in each of the plurality of sets of test data;

comparing the test sound quality score of each of the plurality of test audio files in each set of test data with the sample sound quality score; and triggering the detecting module to determine, using the sound quality detection model, the sound quality score of each of the plurality of audio files based on the correspondence list between the at least one audio feature of each of the plurality of audio files and the audio file identifier in response to determining, based on a comparison result, that the sound quality detection model meets a sound quality detection condition.

Optionally, wherein the processor, when executing the at least one instruction, is further caused to perform:

updating the sound quality detection model based on the plurality of sets of test data in response to determining, based on the comparison result, that the sound quality detection model does not meet the sound quality detection condition; and determining, using the sound quality detection model as updated, the sound quality score of each of the plurality of audio files based on the correspondence list between the at least one audio feature of each of the plurality of audio files and the audio file identifier.

Optionally, the processor, when executing the at least one instruction, is further caused to perform:

selecting first N audio files in the plurality of audio files ranked in descending order of their sound quality scores, wherein N is a positive integer; and determining the N audio files as first-type audio files and audio files other than the N audio files in the plurality of audio files as second-type audio files.

Optionally, the processor, when executing the at least one instruction, is further caused to perform:

deleting the second-type audio files.

According to one aspect, a non-transitory computer-readable storage medium is provided. The computer-readable storage medium stores at least one instruction thereon. The at least one instruction, when executed by a processor, causes the processor to perform any one of the foregoing sound quality detection methods for homologous audio.

According to one aspect, a computer program product is provided. When the computer program product is executed, any one of the foregoing sound quality detection methods for homologous audio is implemented.

BRIEF DESCRIPTION OF THE DRAWINGS

To describe the technical solutions in the embodiments of the present application more clearly, the following briefly introduces the accompanying drawings required for describing the embodiments. Apparently, the accompanying drawings in the following description show merely some embodiments of the present application, and those of ordinary skill in the art may still derive other drawings from these accompanying drawings without creative efforts.

DETAILED DESCRIPTION

Figure 1:
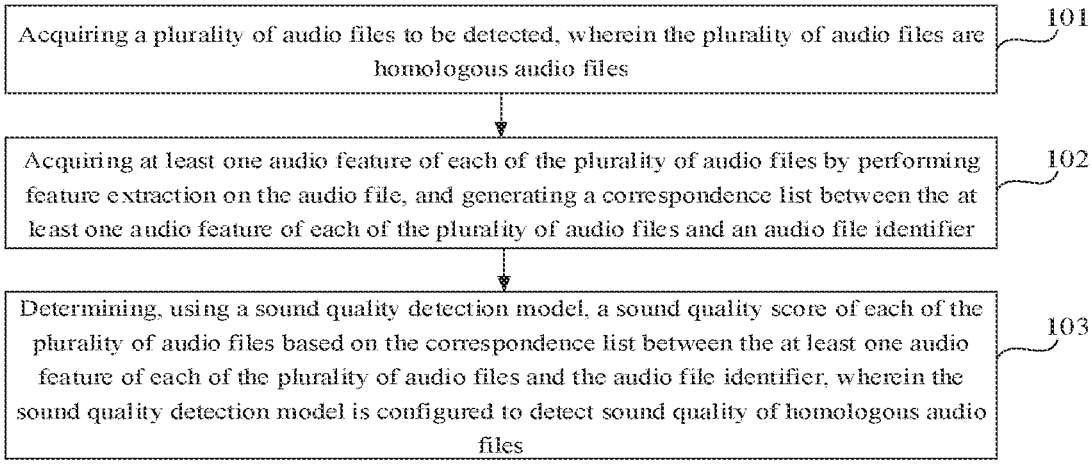
FIG. 1 is a flowchart of a sound quality detection method for homologous audio according to some embodiments of the present application.

To make the objective, technical solutions, and advantages of the present application clearer, embodiments of the present application will be further described in detail with reference to the accompanying drawings.

Before the embodiments of the present application are described in detail, application scenarios of the embodiments of the present application are described.

A sound quality detection method for homologous audio provided in the embodiments of the present application is mainly applied to scenarios related to sound quality detection of homologous audio file. For example, a device such as a terminal, a cloud, or a server may store a large number of homologous audio files. As the sound quality of these homologous audio files is uneven, and the device cannot identify the sound quality of the audio files, the storage pressure and the acquisition pressure of the device are high, and the homologous audio files cannot be effectively managed. For example, a backend server of music software may store a plurality of audio files with different sound quality for the same song, resulting in high storage pressure of the backend server. In addition, a user cannot effectively download a desired audio file with relatively good sound quality from the backend server.

In view of the foregoing problems, the embodiments of the present application provide a method that can detect sound quality of homologous audio files to acquire a sound quality score of each of the homologous audio files, such that these audio files can be effectively managed based on the sound quality score of each audio file. For example, sound quality of a large number of homologous audio files can be quickly and accurately determined based on a sound quality score of each audio file, to improve a capability of identifying sound quality of audio, which facilitates acquiring and retaining of audio files with high sound quality, and prevents information redundancy of a large number of audio files with low sound quality, thereby saving costs of acquiring, storing, and managing the audio files with low sound quality. For example, in homologous audio files, audio files with low sound quality can be deleted and audio files with high sound quality can be retained based on their sound quality scores to reduce the storage pressure of the device.

The following briefly describes an implementation environment involved in the embodiments of the present application. The implementation environment involved in the present application may be a terminal, a server, a sound quality detection system for homologous audio including at least two of a terminal, a server, and a database, or the like. The terminal may be a mobile phone, a tablet computer, a computer, or the like. For example, the terminal may implement the method provided in the embodiments of the present application by using installed audio software. The server may be a backend server of audio software, a server configured to carry a cloud, or the like. The database is used to store audio files, such as one or more sets of homologous audio files.

The following describes the sound quality detection method for homologous audio provided in the embodiments of the present application in detail. FIG. 1 is a flowchart of a sound quality detection method for homologous audio according to some embodiments of the present application. The method may be applied to a terminal, a server, a sound quality detection system for homologous audio including at least two of a terminal, a server, and a database, or the like. As shown in FIG. 1, the method may include the following steps.

In step 101, a plurality of audio files to be detected are acquired, wherein the plurality of audio files are homologous audio files.

Homologous audio files are audio files that can be acquired by transcoding the same audio file one or more times, for example, audio files of the same song with different sound quality.

In step 102, at least one audio feature of each of the plurality of audio files is acquired by performing feature extraction on the audio file, and a correspondence list between the at least one audio feature of each of the plurality of audio files and an audio file identifier is generated.

In step 103, a sound quality score of each of the plurality of audio files is determined based on the correspondence list between the at least one audio feature of each of the plurality of audio files and the audio file identifier by using a sound quality detection model, wherein the sound quality detection model is configured to detect sound quality of homologous audio files.

In this embodiment of the present application, at least one audio feature of each of the plurality of audio files to be detected that are homologous audio files is acquired by performing the feature extraction on the audio file, and the correspondence list between the at least one audio feature of each of the plurality of audio files and the audio file identifier is generated. The sound quality score of each of the plurality of audio files is determined based on the correspondence list by using the sound quality detection model, to detect the sound quality of the homologous audio files, such that the homologous audio files can be stored, acquired, and managed based on the sound quality, thereby saving costs for storing, acquiring, and managing the homologous audio files. In addition, the sound quality of the homologous audio files is detected by using the sound quality detection model that is specially used to detect sound quality of homologous audio files, thereby improving the accuracy and efficiency of sound quality detection.

Optionally, acquiring the at least one audio feature of each of the plurality of audio files by performing the feature extraction on the audio file may specifically include:

by performing the feature extraction on a first audio file in the plurality of audio files, acquiring at least one of a sampling rate, a bit depth, a bitrate, a maximum value among energy roll-off differences of all frames, a spectral contrast, spectral flatness in time, a mean value of an energy shadow region upon audio energy normalization, a mean value and variance of normalized energy of all frames in time, a peak ratio of envelope amplitudes of all frames, spectral entropy, a spectral centroid, and a spectral height of the first audio file, wherein the first audio file is any one of the plurality of audio files.

Optionally, determining, using the sound quality detection model, the sound quality score of each of the plurality of audio files based on the correspondence list between the at least one audio feature of each of the plurality of audio files and the audio file identifier may specifically include:

inputting the correspondence list between the at least one audio feature of each of the plurality of audio files and the audio file identifier to the sound quality detection model, and outputting the sound quality score of each of the plurality of audio files by the sound quality detection model.

Optionally, prior to determining, using the sound quality detection model, the sound quality score of each of the plurality of audio files based on the correspondence list between the at least one audio feature of each of the plurality of audio files and the audio file identifier, the method may further include:

acquiring a plurality of sets of sample data, wherein each of the plurality of sets of sample data includes a plurality of sample audio files that are homologous audio files, and sample sound quality scores of the plurality of sample audio files; and acquiring the sound quality detection model by training a to-be-trained sound quality detection model based on the plurality of sets of sample data.

Optionally, acquiring the plurality of sets of sample data may specifically include:

acquiring a source audio file for any set of sample data in the plurality of sets of sample data;

acquiring the plurality of sample audio files by continuously performing lossy transcoding on the source audio file M times, wherein M is a positive integer;

determining the sample sound quality score of each of the plurality of sample audio files; and determining the plurality of sample audio files and the sample sound quality scores of the plurality of sample audio files as the any set of sample data.

Optionally, acquiring the plurality of sample audio files by continuously performing the lossy transcoding on the source audio file M times may specifically include:

acquiring a lossy audio file by performing the lossy transcoding on the source audio file;

determining the lossy audio file as an $r^{th}$ lossy audio file, and r=1;

acquiring an $(r+1)^{th}$ lossy audio file by performing the lossy transcoding on the $r^{th}$ lossy audio file;

in the case that r+1 is not equal to M, letting r=r+1, and returning to the step of acquiring the $(r+1)^{th}$ lossy audio file by performing the lossy transcoding on the $r^{th}$ lossy audio file; and in the case that r+1 is equal to M, determining the source audio file and the first lossy audio file to an $M^{th}$ lossy audio file as the plurality of sample audio files.

Optionally, prior to determining, using the sound quality detection model, the sound quality score of each of the plurality of audio files based on the correspondence list between the at least one audio feature of each of the plurality of audio files and the audio file identifier, the method may further include:

acquiring a plurality of sets of test data, wherein each set of test data includes a plurality of test audio files that are homologous audio files and sample sound quality scores of the plurality of test audio files;

determining, using the sound quality detection model, a test sound quality score of each of the plurality of test audio files in each of the plurality of sets of test data;

comparing the test sound quality score of each of the plurality of test audio files in each set of test data with the sample sound quality score; and performing the step of determining, using the sound quality detection model, the sound quality score of each of the plurality of audio files based on the correspondence list between the at least one audio feature of each of the plurality of audio files and the audio file identifier in response to determining, based on a comparison result, that the sound quality detection model meets a sound quality detection condition.

Optionally, upon comparing the test sound quality score of each of the plurality of test audio files in each set of test data with the sample sound quality score, the method may further include:

updating the sound quality detection model based on the plurality of sets of test data in response to determining, based on the comparison result, that the sound quality detection model does not meet the sound quality detection condition; and determining, using the sound quality detection model, the sound quality score of each of the plurality of audio files based on the correspondence list between the at least one audio feature of each of the plurality of audio files and the audio file identifier may specifically include:

determining, using the sound quality detection model as updated, the sound quality score of each of the plurality of audio files based on the correspondence list between the at least one audio feature of each of the plurality of audio files and the audio file identifier.

Optionally, upon determining, using the sound quality detection model, the sound quality score of each of the plurality of audio files based on the correspondence list between the at least one audio feature of each of the plurality of audio files and the audio file identifier, the method may further include:

selecting first N audio files in the plurality of audio files ranked in descending order of their sound quality scores, wherein N is a positive integer; and determining the N audio files as first-type audio files and audio files other than the N audio files in the plurality of audio files as second-type audio files.

Optionally, upon determining the N audio files as the first-type audio files, and the audio files other than the N audio files in the plurality of audio files as the second-type audio files, the method may further include:

deleting the second-type audio files.

All the foregoing optional technical solutions can be arbitrarily combined to form optional embodiments of the present application, which are not described one by one in the embodiments of the present application.

Figure 2:
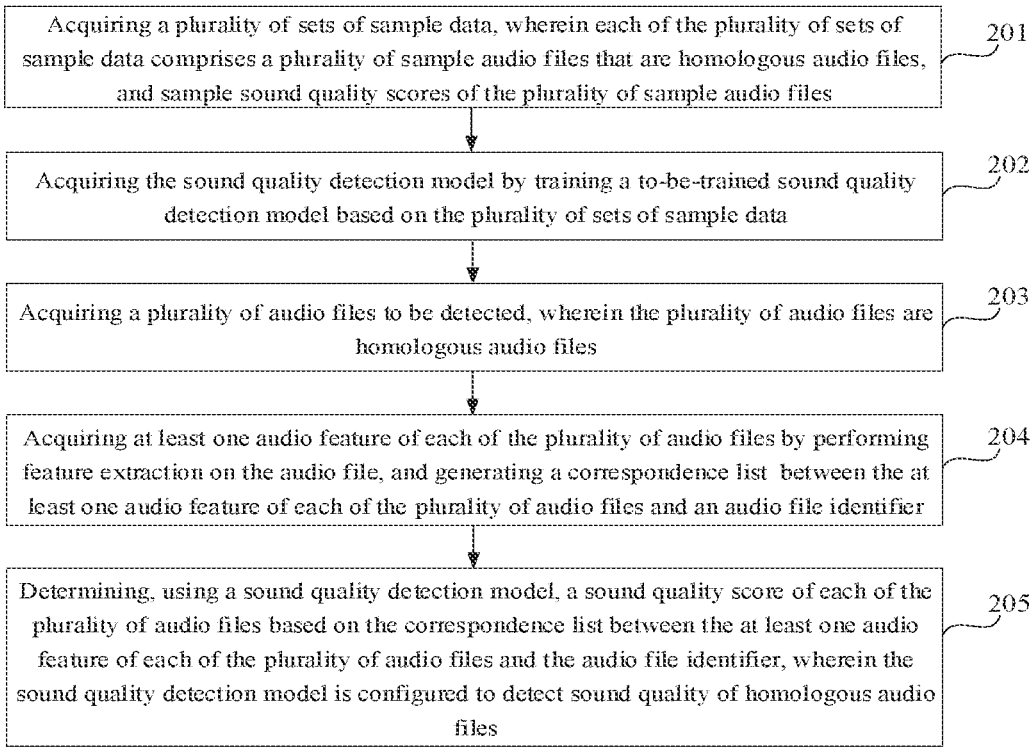
FIG. 2 is a flowchart of another sound quality detection method for homologous audio according to some embodiments of the present application.

FIG. 2 is a flowchart of another sound quality detection method for homologous audio according to some embodiments of the present application. The method may be applied to a terminal, a server, a sound quality detection system for homologous audio including at least two of a terminal, a server, and a database, or the like. For ease of understanding, the method will be described in detail below by taking an example in which the method is applied to the server. As shown in FIG. 2, the method may include the following steps:

In step 201, a plurality of sets of sample data are acquired, wherein each of the plurality of sets of sample data includes a plurality of sample audio files that are homologous audio files, and sample sound quality scores of the plurality of sample audio files.

In this embodiment of the present application, a sound quality detection model can be used to detect sound quality of homologous audio files. To ensure that the sound quality detection model can detect sound quality of homologous audio files, the plurality of sets of sample data need to be acquired first, so as to train the model based on the plurality of sets of sample data.

Each set of sample data includes the plurality of sample audio files that are homologous audio files and the sample sound quality scores of the plurality of sample audio files.

Homologous audio files are audio files that can be acquired by transcoding a same audio file one or more times, for example, audio files of the same song with different sound quality.

For example, it is assumed that a first audio file is acquired by performing lossy transcoding on a source audio file of a song A, and a second audio file is acquired by performing lossy transcoding on the first audio file. Because sound quality after the lossy transcoding is lower than that before the lossy transcoding, sound quality of the first audio file is lower than that of the source audio file, and the sound quality of the second audio file is lower than that of the first audio file. Correspondingly, the source audio file, the first audio file, and the second audio file are homologous audio files of the same song with different sound quality.

The sound quality score described in this embodiment of the present application is used to indicate sound quality of an audio file, and a greater sound quality score indicates higher sound quality. For example, the sound quality of the audio file may be scored to acquire the sound quality score of the audio file. Correspondingly, the sample sound quality score is used to indicate sound quality of a sample audio file, and a greater sample sound quality score indicates higher sound quality.

In some examples, a sample sound quality score of a sample audio file may be determined as a sound quality label of the sample audio file. A plurality of sample audio files that are homologous audio files and sound quality labels of the plurality of sample audio files are determined as a set of sample data.

Specifically, that the plurality of sets of sample data are acquired may specifically include steps 2011 to 2014.

In step 2011, a source audio file for any set of sample data in the plurality of sets of sample data is acquired.

The source audio file corresponds to the any set of sample data.

For example, a plurality of source audio files may be acquired, and each source audio file is processed by performing steps 2012 to 2014 to acquire sample data corresponding to each source audio file, so as to acquire the plurality of sets of sample data.

It should be noted that an audio format of each source audio file is not limited. For example, the audio format may be free lossless audio codec (FLAC), moving picture experts group audio layer III (MP3), Ogg Vorbis, or the like. Audio duration of each source audio file is also not limited. For example, the audio duration may be several minutes, tens of minutes, or the like. The number of channels of each source audio file is also not limited, for example, mono, dual, or multi-channel. In other words, audio formats, audio duration, and numbers of channels of the plurality of source audio files may be the same or different, which is not limited in this embodiment of the present application.

In addition, same source audio files may exist in the plurality of source audio files. Further, to prevent repeated training, the plurality of source audio files are all different. For example, any one of the plurality source audio files may be a lossless audio file, such as an audio file in the FLAC format, or a lossy audio file, such as an audio file in the MP3 format, which is not limited in this embodiment of the present application. In addition, the plurality of source audio files may be processed in parallel or serially, which is not limited in this embodiment of the present application.

In step 2012, the plurality of sample audio files are acquired by continuously performing lossy transcoding on the source audio file M times, wherein M is a positive integer.

It should be noted that the lossy transcoding means that after an audio file is transcoded, a transcoded audio file loses specific information relative to the audio file before the transcoding. Consequently, sound quality of the transcoded audio file is lower than that of the audio file before the transcoding. In an example, the lossy transcoding may be performed by using Fast Forward MPEG (FFmpeg), an open source digital audio transcoding tool.

M lossy audio files can be acquired by continuously performing lossy transcoding on the source audio file M times. Then, the source audio file and the M lossy audio files may be determined as the plurality of sample audio files.

M may be preset, and may be set by a user or the server. For example, M may be 5, 10, 15, or the like. A specific value of M is not limited in this embodiment of the present application.

Specifically, acquiring the plurality of sample audio files by continuously performing the lossy transcoding on the source audio file M times may include steps (1) to (6).

In step (1), a lossy audio file by performing the lossy transcoding on the source audio file is acquired.

Because specific information is lost after the lossy transcoding, sound quality of the lossy audio file is lower than that of the source audio file.

In step (2), the lossy audio file is determined as an $r^{th}$ lossy audio file, and r=1.

In other words, the lossy audio file is used as a first lossy audio file.

In step (3), an $(r+1)^{th}$ lossy audio file is acquired by performing the lossy transcoding on the $r^{th}$ lossy audio file.

Sound quality of the $(r+1)^{th}$ lossy audio file is lower than that of the $r^{th}$ lossy audio file.

For example, if r=1, the lossy transcoding is performed on the first lossy audio file to acquire a second lossy audio file. Sound quality of the second lossy audio file is lower than that of the first lossy audio file.

In step (4), it is determined whether r+1 is equal to M.

If it is determined that r+1 is not equal to M, step (5) is performed. Otherwise, step (6) is performed.

In step (5), in the case that r+1 is not equal to M, r=r+1, and step (3) is returned to. That r=r+1 and step (3) is returned to means to replace r in step (3) with r+1, and perform step (3) again. For example, in the case that r+1 is not equal to M, the lossy transcoding is performed on the $(r+1)^{th}$ lossy audio file to acquire an $(r+2)^{th}$ lossy audio file.

In other words, if r+1 is not equal to M, the number of times for which the lossy transcoding is performed does not reach M. In this case, it is necessary to continue to perform lossy transcoding on the lossy audio file acquired after this lossy transcoding.

In step (6), in the case that r+1 is equal to M, the source audio file and the first lossy audio file to an $M^{th}$ lossy audio file are determined as the plurality of sample audio files.

If r+1 is equal to M, the number of times for which the lossy transcoding is performed reaches M. In this case, the source audio file and the M lossy audio files acquired after the M times of the lossy transcoding are determined as the plurality of sample audio files. In addition, because the sound quality of the audio file further decreases after each lossy transcoding, the sound quality of the first lossy audio file to the $M^{th}$ lossy audio file is decreased sequentially.

Figure 3:
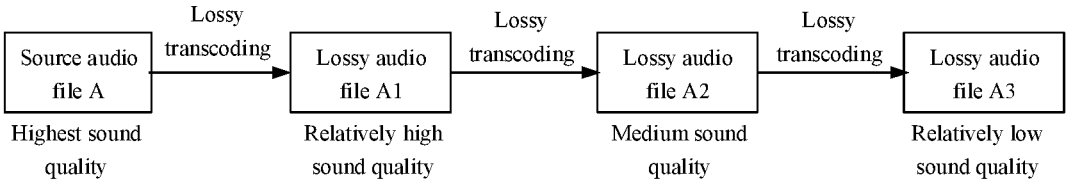
FIG. 3 is a schematic diagram of lossy transcoding according to some embodiments of the present application.

For example, as shown in FIG. 3, it is assumed that M is 3, lossy transcoding is first performed on a source audio file A to acquire a first lossy audio file A1. Then, lossy transcoding is performed on A1 to acquire a second lossy audio file A1. Next, lossy transcoding is performed on A2 to acquire a third lossy audio file A3. A, A1, A2, and A3 may be used as a set of a plurality of sample audio files that are homologous audio files, and sound quality of A, A1, A2, and A3 is decreased sequentially.

It should be noted that in this embodiment of the present application, audio formats of the audio files before and after the transcoding may be the same or different. The audio format includes but is not limited to FLAC, MP3, and Ogg Vorbis.

In step 2013, a sample sound quality score of each of the plurality of sample audio files is determined.

The sample sound quality score of each of the plurality of sample audio files may be set manually or by the server, which is not limited in this embodiment of the present application.

The sample sound quality scores of the plurality of sample audio files are decreased in the sequence of the lossy transcoding. For example, the sample sound quality score of the source audio file may be set to a relatively high sound quality score. Then, in the sequence of the lossy transcoding, the sound quality scores of the subsequent lossy audio files may be sequentially decreased by a sound quality score threshold to acquire the sound quality score of each sample audio file. The sample sound quality scores may alternatively be set in another way. This is not limited in this embodiment of the present application.

For example, for A, A1, A2, and A3 in FIG. 3, a sample sound quality score of A may be set to 100, a sample sound quality score of A1 may be set to 90, a sample sound quality score of A2 may be set to 80, and a sample sound quality score of A3 may be set to 70, such that the sample sound quality scores of the four audio files sequentially decrease.

In step 2014, the plurality of sample audio files and the sample sound quality scores of the plurality of sample audio files are determined as the any set of sample data.

For example, source audio files of a plurality of different songs may be acquired, and each source audio file is processed by performing step 2012 to acquire homologous audio files corresponding to each song. Then, a sound quality score of each of the homologous audio files corresponding to each song is determined. The homologous audio files corresponding to each song and the sound quality scores of the homologous audio files corresponding to the song are determined as a set of sample data.

In step 202, the sound quality detection model is acquired by training a to-be-trained sound quality detection model based on the plurality of sets of sample data.

The to-be-trained sound quality detection model and the sound quality detection model may be machine learning models. For example, the machine learning model may adopt a support vector machine (SVM) machine learning method, such as a ranking SVM algorithm. The SVM is an internationally popular generalized classifier that performs binary classification on data through supervised learning. The Ranking SVM can convert a ranking problem into a classification problem, implement classification through the SVM, and then implement ranking.

Specifically, feature extraction may be performed on the sample audio files in each of the plurality of sets of sample data to acquire an audio feature of each sample audio file. Then, the audio feature of each sample audio file is inputted to the to-be-trained sound quality detection model. A sound quality score of each sample audio file is determined by using the to-be-trained sound quality detection model. The sound quality score of each sample audio file is compared with the sample sound quality score. Parameters of the to-be-trained sound quality detection model are updated based on a comparison result by using a backpropagation algorithm. The to-be-trained sound quality detection model whose parameters are updated is determined as the sound quality detection model.

By updating the parameters of the to-be-trained sound quality detection model, when the updated model detects the sound quality of the sample audio files in the sample data, acquired detection results can gradually approach the sample sound quality scores, to acquire the sound quality detection model that can detect sound quality of homologous audio files. The backpropagation algorithm may be a stochastic gradient descent algorithm or the like.

It should be noted that the plurality of sets of sample data may be used for training in parallel or serially, which is not limited in this embodiment of the present application. For a specific method of performing the feature extraction on the sample audio files, reference may be made to the following related description of step 204. Details are not described herein in this embodiment of the present application.

Further, after the sound quality detection model is acquired by training the to-be-trained sound quality detection model based on the plurality of sets of sample data, a plurality of sets of test data may be acquired. Then, it is determined whether the sound quality detection model meets a sound quality detection condition based on the plurality of sets of test data. Each set of test data includes a plurality of test audio files that are homologous audio files and sample sound quality scores of the plurality of test audio files.

Specifically, a test sound quality score of each of the plurality of test audio files in each of the plurality of sets of test data is determined by using the sound quality detection model. The test sound quality score of each of the plurality of test audio files in each set of test data is compared with the sample sound quality score. When it is determined based on a comparison result that the sound quality detection model meets the sound quality detection condition, the sound quality detection model can be subsequently used to detect sound quality of homologous audio files. When it is determined based on the comparison result that the sound quality detection model does not meet the sound quality detection condition, the sound quality detection model needs to be updated based on the plurality of sets of test data. An updated sound quality detection model is subsequently used to detect sound quality of homologous audio files.

For example, a mean value of a difference between the test sound quality score and sample sound quality score of each test audio file in the plurality of sets of test data may be determined. When the mean value is less than or equal to a reference threshold, it is determined that the sound quality detection model meets the sound quality detection condition. When the mean value is greater than the reference threshold, it is determined that the sound quality detection model does not meet the sound quality detection condition. It may alternatively be determined whether the sound quality detection model meets the sound quality detection condition in another way based on the comparison result.

Further, after the sound quality detection model is updated based on the plurality of sets of test data, test data may further be acquired, and it is determined based on the acquired test data whether the updated sound quality detection model meets the sound quality detection condition. If no, the updated sound quality detection model is further updated based on the acquired test data until a sound quality detection model that meets the sound quality detection condition is acquired.

In step 203, a plurality of audio files to be detected are acquired, wherein the plurality of audio files are homologous audio files.

For example, the plurality of audio files may be different audio files of a same song. For example, audio files of the same song may be acquired from a large amount of audio stored in a database of music software as the audio files to be detected.

In step 204, at least one audio feature of each of the plurality of audio files is acquired by performing feature extraction on the audio file, and a correspondence list between the at least one audio feature of each of the plurality of audio files and an audio file identifier is generated.

The at least one audio feature of each audio file is a feature that can reflect sound quality of the audio file. For example, the at least one audio feature of each audio file may include at least one of a sampling rate, a bit depth, a bitrate, a maximum value among energy roll-off differences of all frames, a spectral contrast, spectral flatness in time, a mean value of an energy shadow region upon audio energy normalization, a mean value and variance of normalized energy of all frames in time, a peak ratio of envelope amplitudes of all frames, spectral entropy, a spectral centroid, and a spectral height.

The sampling rate is the number of audio sampling points per unit time. The bit depth, also referred to as a sampling bit depth, is the byte representation of each sampling point. The bitrate, also referred to as an audio bitrate or a bit rate, is the amount of information that can be conveyed per second in a data stream. A method for determining the maximum value among the energy roll-off difference of all frames includes: A corresponding frequency difference after energy of each frame of an audio signal corresponding to each audio file is decreased by 90% and 99%, and the maximum value among the frequency differences of all frames is determined as the largest value among the energy roll-off differences of all frames. The method for determining the spectral contrast includes: feature extraction is performed on a high-frequency broadband audio signal, and a spectral contrast of the signal within a bandwidth is calculated. The high-frequency broadband audio signal is an audio signal whose bandwidth is greater than a preset threshold, such as an audio signal whose frequency is from 7 kHz to 14 kHz. The spectral flatness in time is frequency-domain flatness of the audio calculated in time domain. The spectral height is a peak frequency corresponding to main energy of the audio in frequency domain.

In an example, acquiring the at least one audio feature of each of the plurality of audio files by performing the feature extraction on the audio file may include: by performing the feature extraction on a first audio file in the plurality of audio files, acquiring at least one of a sampling rate, a bit depth, a bitrate, a maximum value among energy roll-off differences of all frames, a spectral contrast, spectral flatness in time, a mean value of an energy shadow region upon audio energy normalization, a mean value and variance of normalized energy of all frames in time, a peak ratio of envelope amplitudes of all frames, spectral entropy, a spectral centroid, and a spectral height of the first audio file. The first audio file is any one of the plurality of audio files.

It should be noted that the feature extraction may be performed on each audio file in parallel or serially, which is not limited in this embodiment of the present application.

In an example, the at least one audio feature of each audio file may be represented in a form of a list. For example, after the at least one audio feature of each audio file is acquired, the correspondence list between the at least one audio feature of each audio file and the audio file identifier may be generated based on the at least one audio feature and the audio file identifier of the audio file.

For example, the correspondence list between the at least one audio feature of each audio file and the audio file identifier may be [audio file identifier, audio feature 1, audio feature 2, . . . , audio feature n]. The audio file identifier may be a name or an ID of the audio file. For example, if the audio file is a song file, the audio file identifier may be a song name, ID, or the like.

For example, if a correspondence list of an audio file is represented by List_Return, an audio file identifier is represented by strname, and an audio feature is represented by character, the correspondence list of the audio file may be List_Return=[strname, character1, character2, . . . , charactern]. Each List_Return represents a name and audio features of an audio file.

In step 205, a sound quality score of each of the plurality of audio files is determined based on the correspondence list between the at least one audio feature of each of the plurality of audio files and the audio file identifier by using the sound quality detection model.

The sound quality detection model is configured to detect sound quality of homologous audio files. Specifically, the correspondence list between the at least one audio feature of each of the plurality of audio files and the audio file identifier may be inputted to the sound quality detection model, and the sound quality score of each of the plurality of audio files is output by the sound quality detection model.

Further, after the sound quality score of each of the plurality of audio files is determined based on the correspondence list between the at least one audio feature of each of the plurality of audio files and the audio file identifier by the sound quality detection model, sound quality of the plurality of audio files may be identified based on the sound quality scores of the plurality of audio files. For example, the plurality of audio files may be ranked in descending order of their sound quality scores, and top ranked audio files are identified as audio files with relatively high sound quality, and bottom ranked audio files are identified as audio files with relatively low sound quality.

For example, first N audio files in the plurality of audio files ranked in descending order of their sound quality scores may be selected. The N audio files are determined as first-type audio files, and audio files other than the N audio files in the plurality of audio files are determined as second-type audio files.

N is a positive integer. A specific value of N may be set manually, by the server, or dynamically based on the number of the plurality of audio files. The first-type audio files are audio files with relatively high sound quality, and the second-type audio files are audio files with relatively low sound quality.

Further, after the first-type audio files and second-type audio files are determined, the second-type audio files may be deleted. In this way, the audio files with the relatively low sound quality can be deleted, and only those with the relatively sound quality are retained, such that audio files with low sound quality in the homologous audio files are deleted and those with high sound quality are retained. This prevents a large amount of redundant information of audio with low sound quality, and greatly reduces costs of storing, acquiring, and managing the homologous audio files.

It should be noted that steps 201 and 202 are optional steps. After the sound quality detection model that meets the sound quality detection condition is acquired, steps 201 and 202 may not be performed, and the sound quality detection model may be directly used to perform step 203 to 205 to test the sound quality of the homologous audio files.

In this embodiment of the present application, at least one audio feature of each of the plurality of audio files to be detected that are homologous audio files is acquired by performing the feature extraction on the audio file, and the correspondence list between the at least one audio feature of each of the plurality of audio files and the audio file identifier is generated. The sound quality score of each of the plurality of audio files is determined based on the correspondence list by using the sound quality detection model, to detect the sound quality of the homologous audio files, such that the homologous audio files can be stored, acquired, and managed based on the sound quality, thereby saving costs for storing, acquiring, and managing the homologous audio files. In addition, the sound quality of the homologous audio files is detected by using the sound quality detection model that is specially used to detect sound quality of homologous audio files, thereby improving the accuracy and efficiency of sound quality detection.

Figure 4:
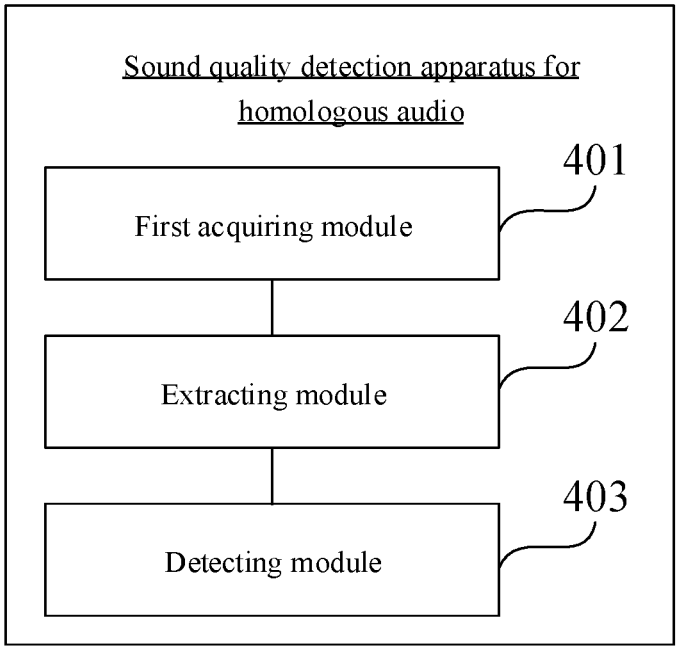
FIG. 4 is a structural block diagram of a sound quality detection apparatus for homologous audio according to some embodiments of the present application.

FIG. 4 is a structural block diagram of a sound quality detection apparatus for homologous audio according to some embodiments of the present application. As shown in FIG. 4, the apparatus includes a first acquisition module 401, an extracting module 402, and a detecting module 403.

The first acquiring module 401 is configured to acquire a plurality of audio files to be detected, wherein the plurality of audio files are homologous audio files.

The extracting module 402 is configured to acquire at least one audio feature of each of the plurality of audio files by performing feature extraction on the audio file, and generate a correspondence list between the at least one audio feature of each of the plurality of audio files and an audio file identifier.

The detecting module 403 is configured to determine, using a sound quality detection model, a sound quality score of each of the plurality of audio files based on the correspondence list between the at least one audio feature of each of the plurality of audio files and the audio file identifier, wherein the sound quality detection model is configured to detect sound quality of homologous audio files.

In this embodiment of the present application, at least one audio feature of each of the plurality of audio files to be detected that are homologous audio files is acquired by performing the feature extraction on the audio file, and the correspondence list between the at least one audio feature of each of the plurality of audio files and the audio file identifier is generated. The sound quality score of each of the plurality of audio files is determined based on the correspondence list by using the sound quality detection model, to detect the sound quality of the homologous audio files, such that the homologous audio files can be stored, acquired, and managed based on the sound quality, thereby saving costs for storing, acquiring, and managing the homologous audio files. In addition, the sound quality of the homologous audio files is detected by using the sound quality detection model that is specially used to detect sound quality of homologous audio files, thereby improving the accuracy and efficiency of sound quality detection.

Optionally, the extracting module 402 may be specifically configured to:

by performing the feature extraction on a first audio file in the plurality of audio files, acquire at least one of a sampling rate, a bit depth, a bitrate, a maximum value among energy roll-off differences of all frames, a spectral contrast, spectral flatness in time, a mean value of an energy shadow region upon audio energy normalization, a mean value and variance of normalized energy of all frames in time, a peak ratio of envelope amplitudes of all frames, spectral entropy, a spectral centroid, and a spectral height of the first audio file, wherein the first audio file is any one of the plurality of audio files.

Optionally, the detecting module 403 may be specifically configured to:

input the correspondence list between the at least one audio feature of each of the plurality of audio files and the audio file identifier to the sound quality detection model, and output the sound quality score of each of the plurality of audio files by the sound quality detection model.

Optionally, the apparatus may further include:

a second acquiring module, configured to acquire a plurality of sets of sample data, wherein each of the plurality of sets of sample data includes a plurality of sample audio files that are homologous audio files and sample sound quality scores of the plurality of sample audio files; and a training module, configured to acquire the sound quality detection model by training a to-be-trained sound quality detection model based on the plurality of sets of sample data.

Optionally, the second acquiring module may include:

an acquiring unit, configured to acquire a source audio file for any set of sample data in the plurality of sets of sample data;

a transcoding unit, configured to acquire the plurality of sample audio files by continuously performing lossy transcoding on the source audio file M times, wherein M is a positive integer;

a first determining unit, configured to determine the sample sound quality score of each of the plurality of sample audio files; and a second determining unit, configured to determine the plurality of sample audio files and the sample sound quality scores of the plurality of sample audio files as the any set of sample data.

Optionally, the transcoding unit may be specifically configured to:

acquire a lossy audio file by performing the lossy transcoding on the source audio file;

determine the lossy audio file as an $r^{th}$ lossy audio file, and let r=1;

acquire an $(r+1)^{th}$ lossy audio file by performing the lossy transcoding on the $r^{th}$ lossy audio file;

in the case that r+1 is not equal to M, let r=r+1, and return to the step of acquiring the $(r+1)^{th}$ lossy audio file by performing the lossy transcoding on the $r^{th}$ lossy audio file; and in the case that r+1 is equal to M, determine the source audio file and the first lossy audio file to an $M^{th}$ lossy audio file as the plurality of sample audio files.

Optionally, the apparatus may further include:

a third acquiring module, configured to acquire a plurality of sets of test data, wherein each set of test data includes a plurality of test audio files that are homologous audio files and sample sound quality scores of the plurality of test audio files;

a first determining module, configured to determine, using the sound quality detection model, a test sound quality score of each of the plurality of test audio files in each of the plurality of sets of test data;

a comparing module, configured to compare the test sound quality score of each of the plurality of test audio files in each set of test data with the sample sound quality score; and a triggering module, configured to trigger the detecting module to determine, using the sound quality detection model, the sound quality score of each of the plurality of audio files based on the correspondence list between the at least one audio feature of each of the plurality of audio files and the audio file identifier in response to determining, based on a comparison result, that the sound quality detection model meets a sound quality detection condition.

Optionally, the apparatus may further include:

an updating module, configured to update the sound quality detection model based on the plurality of sets of test data in response to determining, based on the comparison result, that the sound quality detection model does not meet the sound quality detection condition.

The detecting module may be specifically configured to:

determine, using the sound quality detection model as updated, the sound quality score of each of the plurality of audio files based on the correspondence list between the at least one audio feature of each of the plurality of audio files and the audio file identifier.

Optionally, the apparatus may further include:

a selecting module, configured to select first N audio files in the plurality of audio files ranked in descending order of their sound quality scores, wherein N is a positive integer; and a second determining module, configured to determine the N audio files as first-type audio files and audio files other than the N audio files in the plurality of audio files as second-type audio files.

Optionally, the apparatus may further include:

a deleting module, configured to delete the second-type audio files.

It should be noted that when the sound quality detection apparatus for homologous audio provided in the foregoing embodiment detects sound quality of homologous audio files, the division of the foregoing functional modules is merely used as an example for illustration. In practical application, the foregoing functions may be allocated to different functional modules as required. In other words, an internal structure of the apparatus is divided into different functional modules to complete all or some of the foregoing functions. In addition, the sound quality detection apparatus for homologous audio provided in the foregoing embodiment belongs to the same concept as the sound quality detection method for homologous audio. For a specific implementation process, refer to the method embodiments. Details are not described herein.

Figure 5:
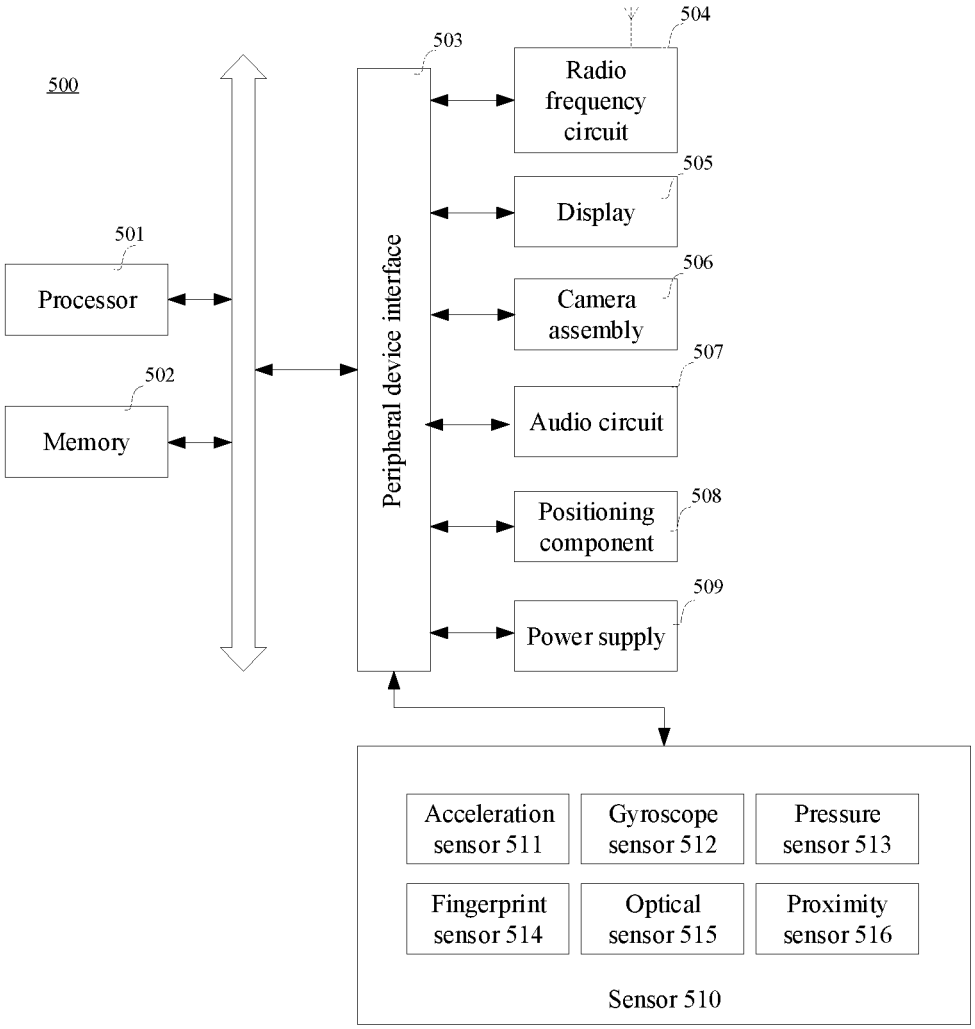
FIG. 5 is a structural block diagram of a terminal according to some embodiments of the present application.

FIG. 5 is a structural block diagram of a terminal 500 according to an embodiment of the present application. The terminal 500 may be a smartphone, a tablet computer, an MP3 player, an MPEG audio layer IV (MP4) player, a notebook computer, or a desktop computer. The terminal 500 may also be referred to as user equipment, a portable terminal, a laptop terminal, a desktop terminal, or the like.

Generally, the terminal 500 includes a processor 501 and a memory 502.

The processor 501 may include one or more processing cores, for example, may be a four-core processor or an eight-core processor. The processor 501 may be implemented by using at least one hardware form of digital signal processing (DSP), a field-programmable gate array (FPGA), and a programmable logic array (PLA). The processor 501 may alternatively include a main processor and a coprocessor. The main processor is configured to process data in an awake state, also referred to as a central processing unit (CPU), and the coprocessor is a low-power processor configured to process data in a standby state. In some embodiments, the processor 501 may be integrated with a graphics processing unit (GPU). The GPU is configured to be responsible for rendering and drawing content that a display needs to display. In some embodiments, the processor 501 may further include an artificial intelligence (AI) processor. The AI processor is configured to process computing operations related to machine learning.

The memory 502 may include one or more computer-readable storage media, which may be non-transitory. The memory 502 may further include a high-speed random access memory and a non-volatile memory such as one or more magnetic disk storage devices and a flash storage device. In some embodiments, the non-transitory computer-readable storage medium in the memory 502 is configured to store at least one instruction. The at least one instruction is executed by the processor 501 to implement the sound quality detection method for homologous audio provided in the method embodiments of the present application.

In some embodiments, the terminal 500 may further optionally include a peripheral device interface 503 and at least one peripheral device. The processor 501, the memory 502, and the peripheral device interface 503 may be connected by using a bus or a signal cable. Each peripheral device may be connected to the peripheral device interface 503 by using a bus, a signal cable, or a circuit board. Specifically, the peripheral device includes at least one of a radio frequency circuit 504, a touch display 505, a camera assembly 506, an audio circuit 507, a positioning component 508, and a power supply 509.

The peripheral device interface 503 may be configured to connect at least one peripheral device related to input/output (I/O) to the processor 501 and the memory 502. In some embodiments, the processor 501, the memory 502, and the peripheral device interface 503 are integrated into a same chip or circuit board. In some other embodiments, any one or two of the processor 501, the memory 502, and the peripheral device interface 503 may be implemented on an independent chip or circuit board. This is not limited in this embodiment.

The radio frequency circuit 504 is configured to receive and transmit a radio frequency signal, also referred to as an electromagnetic signal. The radio frequency circuit 504 communicates with a communications network and another communications device over the electromagnetic signal. The radio frequency circuit 504 may convert an electrical signal into an electromagnetic signal for transmission, or convert a received electromagnetic signal into an electrical signal. Optionally, the radio frequency circuit 504 includes an antenna system, a radio frequency transceiver, one or more amplifiers, a tuner, an oscillator, a digital signal processor, a codec chip set, a subscriber identity module card, and the like. The radio frequency circuit 504 may communicate with another terminal through at least one wireless communication protocol. The wireless communication protocol includes but is not limited to a metropolitan area network, generations of mobile communication networks (2G, 3G, 4G, and 5G), a wireless local area network, and/or a wireless fidelity (Wi-Fi) network. In some embodiments, the radio frequency circuit 504 may further include a near field communication (NFC)-related circuit. This is not limited in the present application.

The display 505 is configured to display a user interface (UI). The UI may include a graph, text, an icon, a video, and any combination thereof. When the display 505 is a touch display, the display 505 is further capable of acquiring a touch signal on or above a surface of the display 505. The touch signal may be inputted to the processor 501 for processing as a control signal. In this case, the touch display 505 may be further configured to provide a virtual button and/or a virtual keyboard, which is also referred to as a soft button and/or a soft keyboard. In some embodiments, there may be one display 505, disposed on a front panel of the terminal 500. In some other embodiments, there may be at least two displays 505, disposed on different surfaces of the terminal 500 or in a folded design. In still other embodiments, the display 505 may be a flexible display, disposed on a curved surface or a folded surface of the terminal 500. Even, the display 505 may alternatively be set in a non-rectangular irregular pattern, namely, a special-shaped screen. The display 505 may be prepared by using materials such as a liquid crystal display (LCD), an organic light-emitting diode (OLED), or the like.

The camera assembly 506 is configured to acquire an image or a video. Optionally, the camera assembly 506 includes a front-facing camera and a rear-facing camera. Generally, the front-facing camera is disposed on a front panel of the terminal, and the rear-facing camera is disposed on a back surface of the terminal. In some embodiments, there are at least two rear-facing cameras, each of which is any one of a main camera, a depth-of-field camera, a wide-angle camera, and a telephoto camera, to implement a background blurring function by fusing the main camera and the depth-of-field camera, and panoramic shooting and virtual reality (VR) shooting functions or other fusing shooting functions by fusing the main camera and the wide-angle camera. In some embodiments, the camera assembly 506 may further include a flash. The flash may be a single color temperature flash or a double color temperature flash. The double color temperature flash is a combination of a warm light flash and a cold light flash, and may be used for light compensation under different color temperatures.

The audio circuit 507 may include a microphone and a speaker. The microphone is configured to acquire sound waves of a user and an environment, and convert the sound waves into electrical signals and input the electrical signals into the processor 501 for processing, or input the electrical signals into the radio frequency circuit 504 to implement voice communication. For the purpose of stereo sound acquisition or noise reduction, there may be a plurality of microphones, disposed at different parts of the terminal 500. The microphone may be further an array microphone or an omnidirectional acquisition microphone. The speaker is configured to convert electrical signals from the processor 501 or the radio frequency circuit 504 into sound waves. The speaker may be a conventional thin-film speaker or a piezoelectric ceramic speaker. In a case that the speaker is the piezoelectric ceramic speaker, electric signals not only can be converted into sound waves audible to human, but also can be converted into sound waves inaudible to human for ranging and other purposes. In some embodiments, the audio circuit 507 may further include an earphone jack.

The positioning component 508 is configured to position a current geographic location of the terminal 500, to implement navigation or a location-based service (LBS). The positioning component 508 may be the United States' Global Positioning System (GPS), Russia's Global Navigation Satellite System (GLONASS), China's BeiDou Navigation Satellite System (BDS), and the European Union's Galileo Satellite Navigation System (Galileo).

The power supply 509 is configured to supply power for each component in the terminal 500. The power supply 509 may be an alternating current, a direct current, a disposable battery, or a rechargeable battery. When the power supply 509 includes the rechargeable battery, the rechargeable battery may support wired charging or wireless charging. The rechargeable battery may be further configured to support a fast charge technology.

In some embodiments, the terminal 500 further includes one or more sensors 510. The one or more sensors 510 include but are not limited to an acceleration sensor 511, a gyroscope sensor 512, a pressure sensor 513, a fingerprint sensor 514, an optical sensor 515, and a proximity sensor 516.

The acceleration sensor 511 may detect acceleration on three coordinate axes of a coordinate system established by the terminal 500. For example, the acceleration sensor 511 may be configured to detect components of gravity acceleration on the three coordinate axes. The processor 501 may control, based on a gravity acceleration signal acquired by the acceleration sensor 511, the touch display 505 to display the user interface in a landscape view or a portrait view. The acceleration sensor 511 may be further configured to acquire game or user motion data.

The gyroscope sensor 512 may detect a body direction and a rotation angle of the terminal 500. The gyroscope sensor 512 may cooperate with the acceleration sensor 511 to acquire a 3D action performed by the user on the terminal 500. The processor 501 may implement the following functions based on the data acquired by the gyroscope sensor 512: motion sensing (such as changing the UI based on a tilt operation of the user), image stabilization at shooting, game control, and inertial navigation.

The pressure sensor 513 may be disposed on a side frame of the terminal 500 and/or a lower layer of the touch display 505. When the pressure sensor 513 is disposed on the side frame of the terminal 500, a holding signal of the user on the terminal 500 may be detected. The processor 501 performs left and right hand recognition or a quick operation based on the holding signal acquired by the pressure sensor 513. When the pressure sensor 513 is disposed on the lower layer of the touch display 505, the processor 501 controls an operable control on the UI based on a pressure operation of the user on the touch display 505. The operable control includes at least one of a button control, a scroll bar control, an icon control and a menu control.

The fingerprint sensor 514 is configured to acquire a fingerprint of a user, and the processor 501 identifies an identity of the user based on the fingerprint acquired by the fingerprint sensor 514, or the fingerprint sensor 514 identifies an identity of the user based on the acquired fingerprint. When the identity of the user is identified as a trusted identity, the processor 501 authorizes the user to perform a related sensitive operation. The sensitive operation includes unlocking a screen, viewing encrypted information, downloading software, payment, changing settings, and the like. The fingerprint sensor 514 may be disposed on a front surface, a back surface, or a side surface of the terminal 500. When the terminal 500 is provided with a physical button or a vendor logo, the fingerprint sensor 514 may be integrated with the physical button or the vendor logo.

The optical sensor 515 is configured to acquire ambient light intensity. In an embodiment, the processor 501 may control display luminance of the touch display 505 based on the ambient light intensity acquired by the optical sensor 515. Specifically, when the ambient light intensity is relatively high, the display luminance of the touch display 505 is turned up. When the ambient light intensity is relatively low, the display luminance of the touch display 505 is turned down. In another embodiment, the processor 501 may further dynamically adjust a camera parameter of the camera assembly 506 based on the ambient light intensity acquired by the optical sensor 515.

The proximity sensor 516, also referred to as a distance sensor, is usually disposed on the front panel of the terminal 500. The proximity sensor 516 is configured to acquire a distance between a user and the front surface of the terminal 500. In an embodiment, when the proximity sensor 516 detects that the distance between the user and the front surface of the terminal 500 gradually becomes smaller, the processor 501 controls the touch display 505 to switch from a screen-on state to a screen-off state. When the proximity sensor 516 detects that the distance between the user and the front surface of the terminal 500 gradually becomes larger, the processor 501 controls the touch display 505 to switch from the screen-off state to the screen-on state.

A person skilled in the art may understand that the structure shown in FIG. 5 does not constitute a limitation to the terminal 500, and the terminal may include more or fewer components than those shown in the figure, or some components may be combined, or a different component deployment may be used.

In this embodiment, the terminal may further include one or more programs. The one or more programs are stored in the memory and executed by one or more processors. The one or more programs include instructions used to perform the sound quality detection method for homologous audio provided in the embodiments of the present application.

Figure 6:
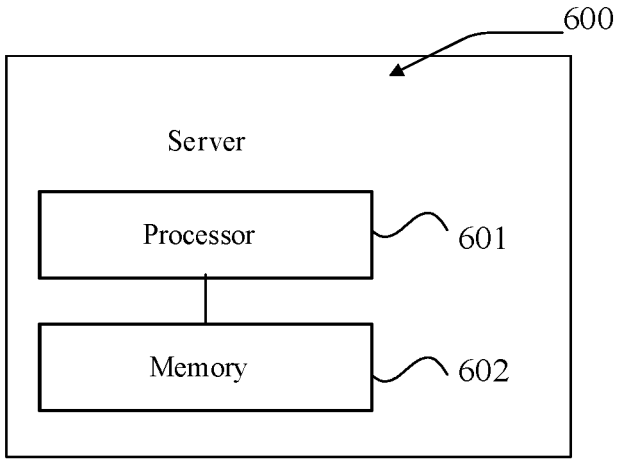
FIG. 6 is a structural block diagram of a server according to some embodiments of the present application.

FIG. 6 is a structural block diagram of a server 600 according to some embodiments of the present application. The server 600 may have relatively large differences due to different configurations or performance, and may include one or more processors (CPUs) 601 and one or more memories 602. The memory 602 stores at least one instruction. The at least one instruction is loaded and executed by the processor 601 to implement the sound quality detection method for homologous audio provided in the foregoing method embodiments. The server 600 may further include components such as a wired or wireless network interface, a keyboard, and an I/O interface for input and output. The server 600 may further include other components for implementing device functions. Details are not described herein.

An embodiment of the present application further provides a computer-readable storage medium. The computer-readable storage medium stores at least one instruction. When the at least one instruction, when executed by a processor, causes the processor to perform the sound quality detection method for homologous audio described in the foregoing embodiments.

Those of ordinary skill in the art can understand that all or some of the steps in the foregoing embodiments may be implemented by hardware, or by instructing related hardware by using a program. The program may be stored in a computer-readable storage medium. The storage medium may be a read-only memory, a disk, a compact disc, or the like.

The foregoing descriptions are merely preferred embodiments of the present application and are not intended to limit the present application. Any modification, equivalent replacement, and improvement within the spirit and principle of the present application shall be included within the protection scope of the present application.

What is claimed is:

1. A sound quality detection method for homologous audio, comprising:

acquiring a plurality of audio files to be detected, wherein the plurality of audio files are homologous audio files;

acquiring at least one audio feature of each of the plurality of audio files by performing feature extraction on the audio file, and generating a correspondence list between the at least one audio feature of each of the plurality of audio files and an audio file identifier; and determining, using a sound quality detection model, a sound quality score of each of the plurality of audio files based on the correspondence list between the at least one audio feature of each of the plurality of audio files and the audio file identifier, wherein the sound quality detection model is configured to detect sound quality of homologous audio files;

wherein prior to determining, using the sound quality detection model, the sound quality score of each of the plurality of audio files based on the correspondence list between the at least one audio feature of each of the plurality of audio files and the audio file identifier, the method further comprises:

acquiring a plurality of sets of sample data, wherein each of the plurality of sets of sample data comprises a plurality of sample audio files that are homologous audio files, and sample sound quality scores of the plurality of sample audio files; and acquiring the sound quality detection model by training a to-be-trained sound quality detection model based on the plurality of sets of sample data; and wherein acquiring the plurality of sets of sample data comprises:

acquiring a source audio file for any set of sample data in the plurality of sets of sample data;

acquiring the plurality of sample audio files by continuously performing lossy transcoding on the source audio file M times, wherein M is a positive integer;

determining the sample sound quality score of each of the plurality of sample audio files; and determining the plurality of sample audio files and the sample sound quality scores of the plurality of sample audio files as the any set of sample data.

2. The method according to claim 1, wherein acquiring the at least one audio feature of each of the plurality of audio files by performing the feature extraction on the audio file comprises:

by performing the feature extraction on a first audio file in the plurality of audio files, acquiring at least one of a sampling rate, a bit depth, a bitrate, a maximum value among energy roll-off differences of all frames, a spectral contrast, spectral flatness in time, a mean value of an energy shadow region upon audio energy normalization, a mean value and variance of normalized energy of all frames in time, a peak ratio of envelope amplitudes of all frames, spectral entropy, a spectral centroid, and a spectral height of the first audio file, wherein the first audio file is any one of the plurality of audio files.

3. The method according to claim 1, wherein determining, using the sound quality detection model, the sound quality score of each of the plurality of audio files based on the correspondence list between the at least one audio feature of each of the plurality of audio files and the audio file identifier comprises:

inputting the correspondence list between the at least one audio feature of each of the plurality of audio files and the audio file identifier to the sound quality detection model, and outputting the sound quality score of each of the plurality of audio files by the sound quality detection model.

4. The method according to claim 1, wherein acquiring the plurality of sample audio files by continuously performing the lossy transcoding on the source audio file M times comprises:

acquiring a lossy audio file by performing the lossy transcoding on the source audio file;

determining the lossy audio file as an $r^{th}$ lossy audio file, and letting r=1;

acquiring an $(r+1)^{th}$ lossy audio file by performing the lossy transcoding on the $r^{th}$ lossy audio file;

in the case that r+1 is not equal to M, letting r=r+1, and returning to the step of acquiring the $(r+1)^{th}$ lossy audio file by performing the lossy transcoding on the $r^{th}$ lossy audio file; and in the case that r+1 is equal to M, determining the source audio file and a first lossy audio file to an $M^{th}$ lossy audio file as the plurality of sample audio files.

5. The method according to claim 1, wherein prior to determining, using the sound quality detection model, the sound quality score of each of the plurality of audio files based on the correspondence list between the at least one audio feature of each of the plurality of audio files and the audio file identifier, the method further comprises:

acquiring a plurality of sets of test data, wherein each set of test data comprises a plurality of test audio files that are homologous audio files and sample sound quality scores of the plurality of test audio files;

determining, using the sound quality detection model, a test sound quality score of each of the plurality of test audio files in each of the plurality of sets of test data;

comparing the test sound quality score of each of the plurality of test audio files in each set of test data with the sample sound quality score; and performing the step of determining, using the sound quality detection model, the sound quality score of each of the plurality of audio files based on the correspondence list between the at least one audio feature of each of the plurality of audio files and the audio file identifier in response to determining, based on a comparison result, that the sound quality detection model meets a sound quality detection condition.

6. The method according to claim 5, wherein upon comparing the test sound quality score of each of the plurality of test audio files in each set of test data with the sample sound quality score, the method further comprises:

updating the sound quality detection model based on the plurality of sets of test data in response to determining, based on the comparison result, that the sound quality detection model does not meet the sound quality detection condition; and determining, using the sound quality detection model, the sound quality score of each of the plurality of audio files based on the correspondence list between the at least one audio feature of each of the plurality of audio files and the audio file identifier comprises:

determining, using the sound quality detection model as updated, the sound quality score of each of the plurality of audio files based on the correspondence list between the at least one audio feature of each of the plurality of audio files and the audio file identifier.

7. The method according to claim 1, wherein upon determining, using the sound quality detection model, the sound quality score of each of the plurality of audio files based on the correspondence list between the at least one audio feature of each of the plurality of audio files and the audio file identifier, the method further comprises:

selecting first N audio files in the plurality of audio files ranked in descending order of their sound quality scores, wherein N is a positive integer; and determining the N audio files as first-type audio files and audio files other than the N audio files in the plurality of audio files as second-type audio files.

8. The method according to claim 7, upon determining the N audio files as the first-type audio files and the audio files other than the N audio files in the plurality of audio files as the second-type audio files, the method further comprises:

deleting the second-type audio files.

9. A sound quality detection device for homologous audio, comprising:

a processor; and a memory configured to store at least one instruction executable by the processor; wherein the processor, when executing the at least one instruction, is caused to perform:

acquiring a plurality of audio files to be detected, wherein the plurality of audio files are homologous audio files;

acquiring at least one audio feature of each of the plurality of audio files by performing feature extraction on the audio file, and generating a correspondence list between the at least one audio feature of each of the plurality of audio files and an audio file identifier; and determining, using a sound quality detection model, a sound quality score of each of the plurality of audio files based on the correspondence list between the at least one audio feature of each of the plurality of audio files and the audio file identifier, wherein the sound quality detection model is configured to detect sound quality of homologous audio files;

wherein the processor, when executing the at least one instruction, is further caused to perform:

acquiring a plurality of sets of sample data, wherein each of the plurality of sets of sample data comprises a plurality of sample audio files that are homologous audio files and sample sound quality scores of the plurality of sample audio files; and acquiring the sound quality detection model by training a to-be-trained sound quality detection model based on the plurality of sets of sample data; and wherein acquiring the plurality of sets of sample data comprises:

acquiring a source audio file for any set of sample data in the plurality of sets of sample data;

acquiring the plurality of sample audio files by continuously performing lossy transcoding on the source audio file M times, wherein M is a positive integer;

determining the sample sound quality score of each of the plurality of sample audio files; and determining the plurality of sample audio files and the sample sound quality scores of the plurality of sample audio files as the any set of sample data.

10. The device according to claim 9, wherein the processor, when executing the at least one instruction, is caused to perform:

by performing the feature extraction on a first audio file in the plurality of audio files, acquiring at least one of a sampling rate, a bit depth, a bitrate, a maximum value among energy roll-off differences of all frames, a spectral contrast, spectral flatness in time, a mean value of an energy shadow region upon audio energy normalization, a mean value and variance of normalized energy of all frames in time, a peak ratio of envelope amplitudes of all frames, spectral entropy, a spectral centroid, and a spectral height of the first audio file, wherein the first audio file is any one of the plurality of audio files.

11. The device according to claim 9, wherein the processor, when executing the at least one instruction, is caused to perform:

inputting the correspondence list between the at least one audio feature of each of the plurality of audio files and the audio file identifier to the sound quality detection model, and outputting the sound quality score of each of the plurality of audio files by the sound quality detection model.

12. The device according to claim 9, wherein the processor, when executing the at least one instruction, is caused to perform:

acquiring a lossy audio file by performing the lossy transcoding on the source audio file;

determining the lossy audio file as an $r^{th}$ lossy audio file, and letting r=1;

acquiring an $(r+1)^{th}$ lossy audio file by performing the lossy transcoding on the $r^{th}$ lossy audio file;

in the case that r+1 is not equal to M, letting r=r+1, and returning to the step of acquiring the $(r+1)^{th}$ lossy audio file by performing the lossy transcoding on the $r^{th}$ lossy audio file; and in the case that r+1 is equal to M, determining the source audio file and a first lossy audio file to an $M^{th}$ lossy audio file as the plurality of sample audio files.

13. The device according to claim 9, wherein the processor, when executing the at least one instruction, is further caused to perform:

acquiring a plurality of sets of test data, wherein each set of test data comprises a plurality of test audio files that are homologous audio files and sample sound quality scores of the plurality of test audio files;

determining, using the sound quality detection model, a test sound quality score of each of the plurality of test audio files in each of the plurality of sets of test data;

comparing the test sound quality score of each of the plurality of test audio files in each set of test data with the sample sound quality score; and determining, using the sound quality detection model, the sound quality score of each of the plurality of audio files based on the correspondence between the at least one audio feature of each of the plurality of audio files and the audio file identifier in response to determining, based on a comparison result, that the sound quality detection model meets a sound quality detection condition.

14. The device according to claim 13, wherein the processor, when executing the at least one instruction, is further caused to perform:

updating the sound quality detection model based on the plurality of sets of test data in response to determining, based on the comparison result, that the sound quality detection model does not meet the sound quality detection condition; and determining, using the sound quality detection model as updated, the sound quality score of each of the plurality of audio files based on the correspondence list between the at least one audio feature of each of the plurality of audio files and the audio file identifier.

15. The device according to claim 9, wherein the processor, when executing the at least one instruction, is further caused to perform:

selecting first N audio files in the plurality of audio files ranked in descending order of their sound quality scores, wherein N is a positive integer; and determining the N audio files as first-type audio files and audio files other than the N audio files in the plurality of audio files as second-type audio files.

16. A non-transitory computer-readable storage medium storing at least one instruction thereon, wherein the at least one instruction, when executed by a processor, causes the processor to perform:

acquiring a plurality of audio files to be detected, wherein the plurality of audio files are homologous audio files;

acquiring at least one audio feature of each of the plurality of audio files by performing feature extraction on the audio file, and generating a correspondence list between the at least one audio feature of each of the plurality of audio files and an audio file identifier; and determining, using a sound quality detection model, a sound quality score of each of the plurality of audio files based on the correspondence list between the at least one audio feature of each of the plurality of audio files and the audio file identifier, wherein the sound quality detection model is configured to detect sound quality of homologous audio files;

wherein the at least one instruction, when executed by a processor, causes the processor to further perform:

acquiring a plurality of sets of sample data, wherein each of the plurality of sets of sample data comprises a plurality of sample audio files that are homologous audio files and sample sound quality scores of the plurality of sample audio files; and acquiring the sound quality detection model by training a to-be-trained sound quality detection model based on the plurality of sets of sample data; and wherein acquiring the plurality of sets of sample data comprises:

acquiring a source audio file for any set of sample data in the plurality of sets of sample data;

acquiring the plurality of sample audio files by continuously performing lossy transcoding on the source audio file M times, wherein M is a positive integer;

determining the sample sound quality score of each of the plurality of sample audio files; and determining the plurality of sample audio files and the sample sound quality scores of the plurality of sample audio files as the any set of sample data.

* * * * *